US010138773B2

(12) United States Patent
Dosky

(10) Patent No.: US 10,138,773 B2
(45) Date of Patent: Nov. 27, 2018

(54) SINGLE HANDED OIL FILTER PUNCHER TOOL SYSTEM AND METHOD

(71) Applicant: Ray-Rekeft Dosky, Kitchner (CA)

(72) Inventor: Ray-Rekeft Dosky, Kitchner (CA)

( * ) Notice: Subject to any disclaimer, the term of this patent is extended or adjusted under 35 U.S.C. 154(b) by 0 days.

(21) Appl. No.: 15/429,497

(22) Filed: Feb. 10, 2017

(65) Prior Publication Data

US 2018/0230872 A1 Aug. 16, 2018

(51) Int. Cl.
*F01M 11/04* (2006.01)
*B67B 7/00* (2006.01)
*F01M 11/03* (2006.01)

(52) U.S. Cl.
CPC ..... *F01M 11/0458* (2013.01); *B67B 7/24* (2013.01); *F01M 11/03* (2013.01)

(58) Field of Classification Search
CPC ..... B67B 7/24; F01M 11/0458; F01M 11/03; F16N 31/00; Y10T 137/6123; Y10T 137/612; B21D 31/02
See application file for complete search history.

(56) References Cited

U.S. PATENT DOCUMENTS 2,361,689 A * 10/1944 Hurd ..... B67B 7/24 30/414
2,376,756 A * 5/1945 Bye ..... B67B 7/24 30/446
2,762,435 A * 9/1956 Morris ..... B25D 5/02 30/367
3,147,550 A * 9/1964 Crookston ..... B21D 31/02 30/366
4,177,529 A * 12/1979 Sikula, Jr. ..... B01D 27/00 141/330
5,299,714 A 5/1994 Kilger
5,390,823 A 2/1995 Kilgore
5,598,951 A 2/1997 DeBano
6,880,252 B1 * 4/2005 Drake ..... B25C 1/02 30/366
7,846,330 B2 12/2010 Nelson
8,651,134 B1 * 2/2014 Kurtz ..... F16N 31/00 137/318

* cited by examiner

*Primary Examiner* — Jonathan Riley
(74) *Attorney, Agent, or Firm* — Michael D. Eisenberg

(57) ABSTRACT

A single handed oil filter puncher tool system and method that operates as an easy and simple time saving device for draining an oil filter during vehicle service with single hand operation. The system is a puncher tool assembly having a handle at a proximate end a perpendicular guide shaft. The tool further includes a sliding punch assembly and an outer sliding sleeve that work together in functional combination as a moving assembly that gets cocked into place while compressing a driving spring. An activation lever releases the sliding punch assembly from the cocked position causing the driving spring to unleash force on the sliding punch assembly. The sliding punch assembly slides along the guide shaft forcing a piercing pin into an oil filter in a single handed operation. The piercing pin punctures the oil filter causing it to drain.

17 Claims, 5 Drawing Sheets

SINGLE HANDED OIL FILTER PUNCHER TOOL SYSTEM AND METHOD

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

1. Field of the Invention

The present invention relates generally to the field of tools of existing art and more specifically relates to filling or draining lubricant of or from machines or engines.

2. Description of Related Art

Vehicle maintenance requires removal and replacement of an oil filter and spin on type fuel filters. These filters contain fluid that must be drained. The sealed nature of the filter requires the seal to be broken exposing the contents or the filter to be punctured in order to drain the filter. Simply removing the filter and exposing the contents often results in spilled oil especially for filters mounted in any orientation besides vertical as well as for filters located in difficult to reach places where manipulating the filter results in orientations that can spill the exposed content. This is not desirable.

U.S. Pat. No. 8,651,134 to Kurtz relates to a tool for oil filter drainage. The described tool for oil filter drainage includes a draining tool useful for controlled draining of a fluid container, such as a threaded spin-on type oil filter. The draining tool includes a piercing pin having a tapered point, striking head, resilient spring, resilient spring retainer assembly, and piercing pin retainer assembly. A better solution is needed.

BRIEF SUMMARY OF THE INVENTION

In view of the foregoing disadvantages inherent in the known tools art, the present disclosure provides a novel single handed oil filter puncher tool system and method. The general purpose of the present disclosure, which will be described subsequently in greater detail, is to provide a single handed oil filter puncher tool system and method for the purpose of efficiently draining oil filters and spin on fuel filters.

Disclosed is a single handed oil filter puncher tool system and method, the system comprising a puncher tool assembly having a combination handle and guide shaft oriented in the same plane having a handle at a proximate end a guide shaft including a hollow inner tube; at least one guide slot; and an opening at a distal end. The guide shaft has a latch assembly mounting tab having a latch assembly mounting bolt hole and a latching assembly. The single handed oil filter puncher tool further includes a sliding punch assembly and an outer sliding sleeve that work together in functional combination as a moving assembly that slides along the guide shaft. The sliding punch assembly has a striking head having a threaded receiver; a threaded retainer bolt hole; and a piercing pin having a tapered point at the proximate end and a threaded male distal end. The striking head having a threaded receiver is a means for removably connecting the piercing pin threaded male distal end. The tapered point of the piercing pin is slotted for easy removal. The sliding punch assembly works in functional combination with an outer sliding sleeve as a means driving the piercing pin into an oil filter when driven by the driving spring. The sliding punch assembly is located within the hollow tube of the guide shaft while the sliding sleeve is on the exterior of the guide shaft.

The threaded retainer bolt hole in the striking head is a means for connecting the sliding punch assembly to the outer sliding sleeve. The threaded retainer bolt hole is configured such that the punch assembly retainer bolt can be tightened against the striking head such that the striking head is clear of the guide shaft as a means for enabling movement and guidance of the sliding punch assembly within the hollow inner tube. The guide slot retains the punch assembly retainer bolt as a means for guiding the sliding punch assembly along the hollow inner tube and the outer sliding sleeve along the guide shaft and limits the punch assembly retainer bolt travel distance along the guide shaft.

The latch assembly includes a first pivot nut and bolt assembly; a pivoting latch lever having a lever tab including a first lever pivot hole; an activation lever having a latching notch and a second lever pivot hole; a second pivot nut and bolt assembly; and a latching spring. The sliding punch assembly is cocked into position by sliding the punch assembly retainer bolt and the outer sliding sleeve as a means for compressing the driver spring to a point that the latching assembly engages the latching notch into the latching cleat. The latching spring automatically engages the latching notch into the latching cleat with and is held into place by force due to the latching spring tension. The activation lever is a means for releasing the latching notch from the latching cleat. The latching assembly mounting bolt and latching assembly mounting self-locking nut are fastened to the latch assembly mounting tab as a means for supporting the latching assembly.

In the preferred embodiment gripping surfaces may be applied to the handle at the proximate end, activation lever, and sliding sleeve. Also in the preferred embodiment, the guide shaft is approximately one foot long as a means for reaching into remote filter locations. Alternate embodiments may feature varying guide shaft lengths for maneuvering in tight spaces or reaching even further distances.

In the preferred embodiment a guide shaft cover is used to protect the user from the extended piercing pin when not in use. Also in the preferred embodiment the distal end of the guide shaft contains an end-member as a means for containing the sliding punch assembly. In alternate embodiments, the end-member is fastened to the guide shaft via threaded male and female receivers as a means to be removably connect the end-member.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a single handed oil filter puncher tool system and method, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to the field of tools and more particularly to a filling or draining lubricant of or from machines or engines as used to improve the draining an oil filter or spin on fuel filter while it is mounted.

Generally speaking, a single handed oil filter puncher tool system and method operates as an easy and simple time saving device for draining an oil filter during vehicle service. The single handed oil filter puncher tool system and method includes a single handed oil filter puncher tool that is a mechanical device which does not require a battery or electricity. The device offers added convenience, saves time, and reduces spilled oil by enabling one hand operation for piercing an oil filter. The oil filter then drains on its own avoiding spilling during removal. The slender nature of the device along with the guide shaft length enable targeting a specific spot on an oil filter even in confined and hard to reach places thus enabling maximum drainage. The device is activated by an internal spring thus avoiding having to provide force when piercing an oil filter. This device can be used in any weather condition.

Referring now more specifically to the drawings by numerals of reference, there is shown in FIGS. 1-4, various views of a single handed oil filter puncher tool system and method 100.

Figure 1:
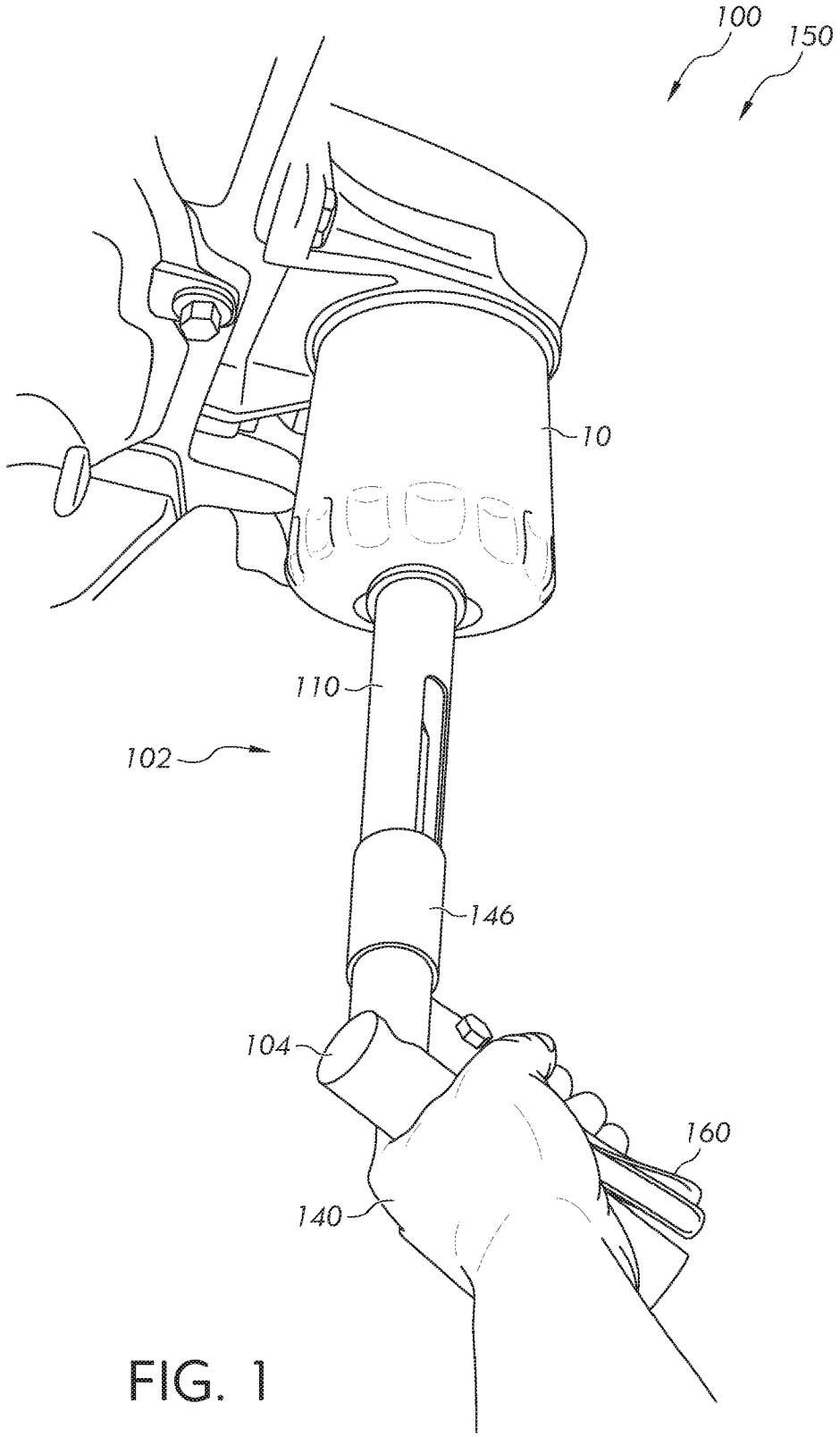
FIG. 1 is an 'in-use' view of the single handed oil filter puncher tool system and method during an 'in-use' condition, according to an embodiment of the disclosure.

FIG. 1 shows a single handed oil filter puncher tool system and method 100 during an 'in-use' condition 150, according to an embodiment of the present disclosure. Here, the single handed oil filter puncher tool system and method 100 may be beneficial for use by a user 140 to pierce an oil filter 10 when it is within an engine compartment. As illustrated, the single handed oil filter puncher tool system and method 100 may include a single handed oil filter puncher tool 102 having a combination handle and guide shaft 104 that is placed against oil filter 10. User squeezes activation lever 160 releasing outer sliding sleeve 146 from a cocked position. Outer sliding sleeve 146 slides along guide shaft 110 punching a hole in oil filter 10. Single handed oil filter puncher tool 102 is then removed from the oil filter 10 allowing oil to drain from oil filter 10.

Figure 2:
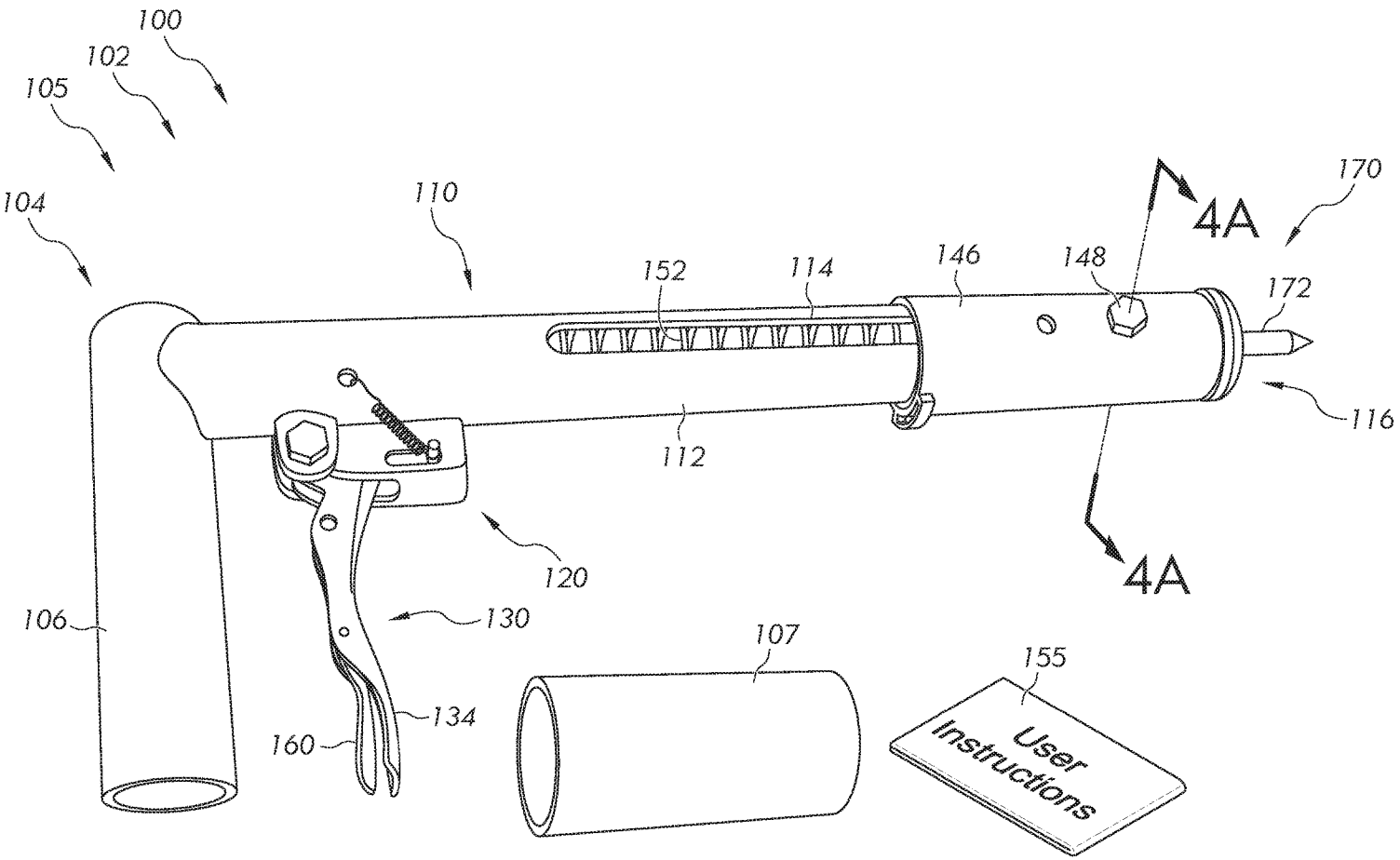
FIG. 2 is a perspective view of the single handed oil filter puncher tool of FIG. 1, according to an embodiment of the present disclosure.

FIG. 2 is a perspective drawing of the single handed oil filter puncher tool 102 when deployed. This view shows the single handed oil filter puncher tool system and method 100 of FIG. 1, according to an embodiment of the present disclosure. As above, the single handed oil filter puncher tool 102 may include: a handle at the proximate end 106 and a guide shaft 110 having a hollow inner tube 112; at least one guide slot 114; and an opening at the distal end 116. Handle at the proximate end 106 and guide shaft 110 are oriented in a single plane at an angle of ninety degrees with respect to each other and work together in functional combination as a structural support and handling means. During operation single handed oil filter puncher tool 102 is held by a single hand by handle at the proximate end 106. In this embodiment, activation lever 160 is self-latching in a vice-gripping condition. Outer sliding sleeve 146 is released from a cocked position by squeezing activation lever 160 against pivoting latch lever 134. Outer sliding sleeve 146 is forced along outer surface of guide shaft 110 by driving spring 152 in functional combination with sliding punch assembly 170 sliding inside hollow inner tube 112 via a connection by punch assembly retainer bolt 148 thereby forcing piercing pin 172 to the opening at the distal end 116 of guide shaft 110. During deployment, punch assembly retainer bolt 148 slides inside at least one guide slot 114.

Referring further to FIG. 2. combination handle and guide shaft 104 includes a latch assembly mounting tab 120. The latch assembly mounting tab 120 supports latching assembly 130.

According to one embodiment, the single handed oil filter puncher tool system and method 100 may be arranged as a kit 105. In particular, the single handed oil filter puncher tool system and method 100 may further include a protective guide shaft cover 107 to protect the user in case of accidental deployment and a set of instructions 155. The instructions 155 may detail functional relationships in relation to the structure of the single handed oil filter puncher tool system and method 100 (such that the single handed oil filter puncher tool system and method 100 can be used, maintained, or the like, in a preferred manner).

Figure 3:
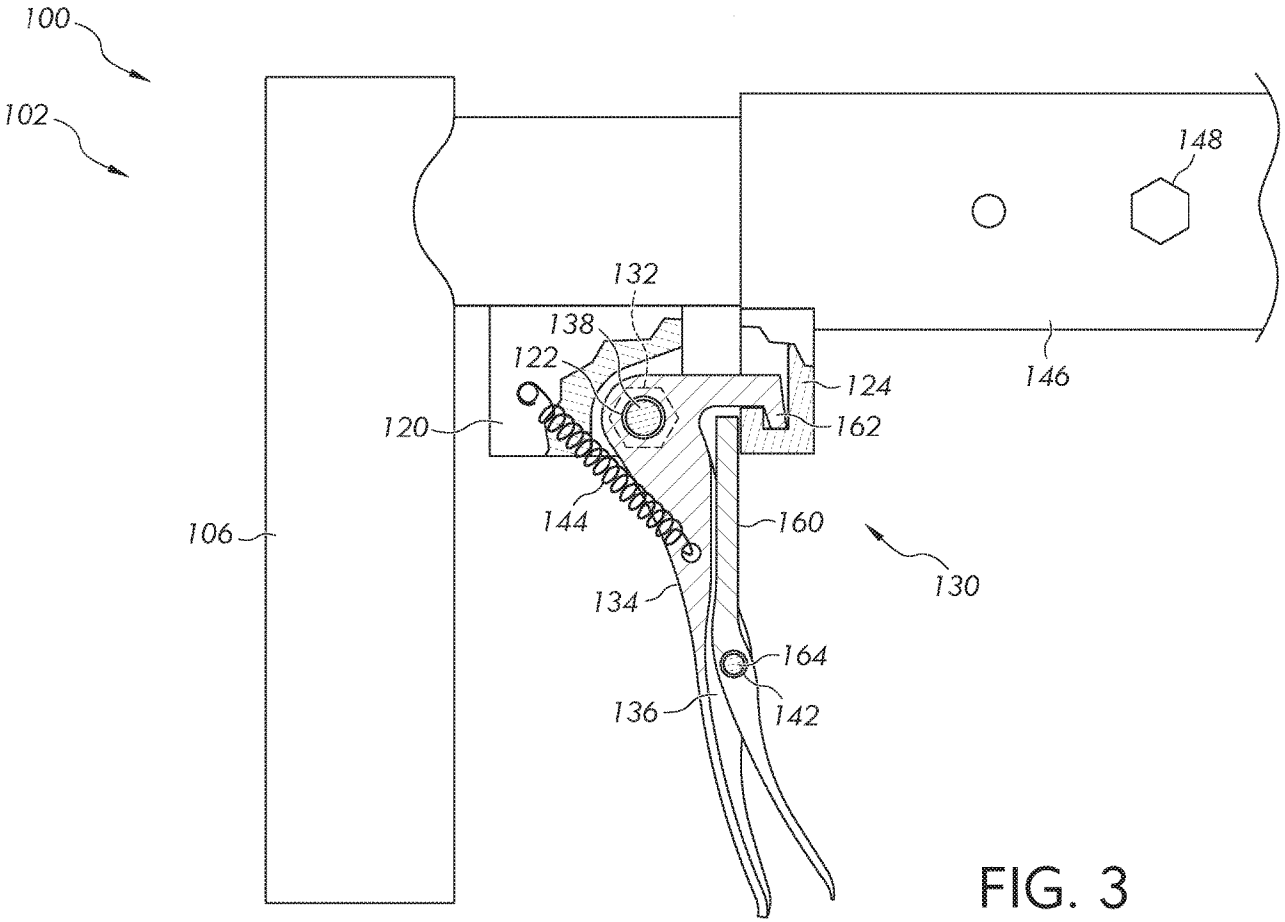
FIG. 3 is a perspective view of the single handed oil filter puncher tool of FIG. 1, according to an embodiment of the present disclosure.

FIG. 3 is a perspective view of the single handed oil filter puncher tool system and method 100 of FIG. 1, according to an embodiment of the present disclosure. In this view the single handed oil filter puncher tool 102 is shown in the cocked position where punch assembly retainer bolt 148 and outer sliding sleeve 146 work together in functional combination as a means for compressing driving spring 152 (FIG. 2) to a point that latching assembly 130 engages latching notch 162 into latching cleat 124. Latching spring 144 automatically engages latching notch 162 into latching cleat 124 with and is held into place by force due to latching spring 144 tension.

Latch assembly mounting tab 120 has a latch assembly mounting bolt hole 122 for mounting latching assembly 130 using first pivot nut and bolt assembly 132. Latching assembly 130 includes pivoting latch lever 134 having first lever pivot hole 138 for mounting via first pivot nut and bolt assembly 132. Pivoting latch lever 134 includes latching notch 162 that locks onto latching cleat 124 due to tension applied by latching spring 144 thus securing outer sliding sleeve 146 while in a cocked position. A puncture sequence is initiated in the following manner: activation lever 160 is squeezed causing it to pivot on second pivot nut and bolt assembly 142 that is mounted in second lever pivot hole 164 through lever tab 136 on pivoting latch lever 134. In this embodiment, activation lever 160 is repositioned for alternate operation when releasing the outer sliding sleeve 146.

Squeezing activation lever 160 results in a lever action releasing latching notch 162 from latching cleat 124 thus enabling release of the functional combination of the outer sliding sleeve 146 and sliding punch assembly 170 (FIG. 2) in turn initiating the aforementioned puncture sequence.

Figure 4:
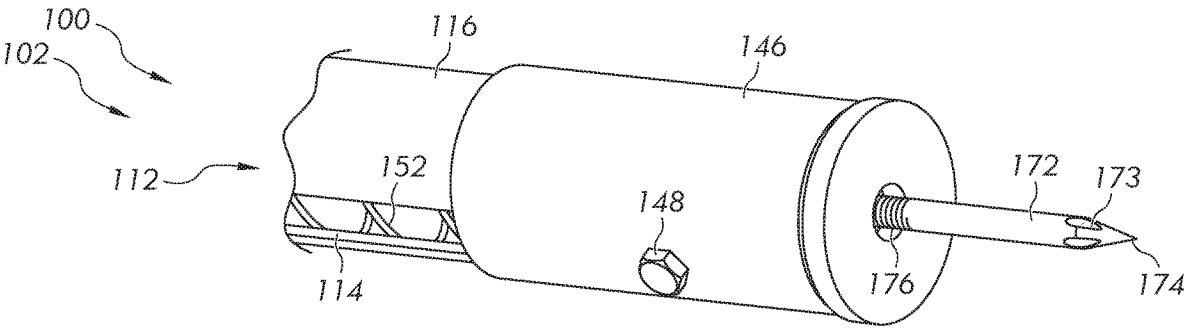
FIG. 4 is a perspective view of the single handed oil filter puncher tool of FIG. 1, according to an embodiment of the present disclosure.
Figure 4A:
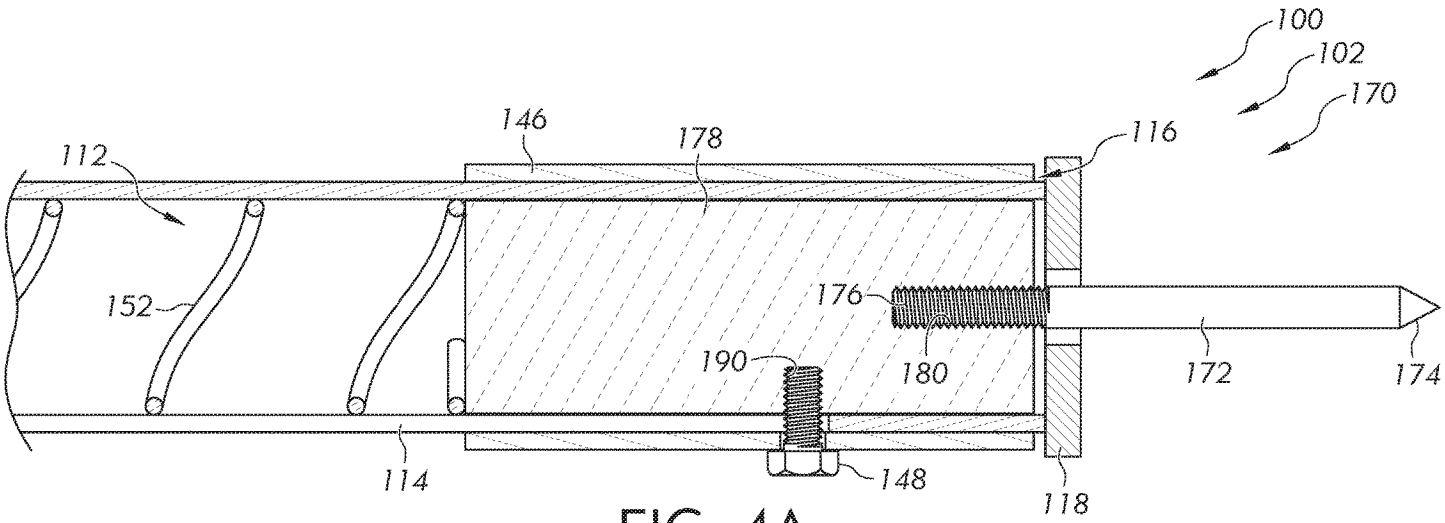
FIG. 4*a* is a perspective view of a cross section of a portion of the single handed oil filter puncher tool of FIG. 1, according to an embodiment of the present disclosure.

FIG. 4 is a perspective view of the single handed oil filter puncher tool 102 of FIG. 1, according to an embodiment of the present disclosure. FIG. 4*a* is a cross-sectional view of the single handed oil filter puncher tool 102 of FIG. 4, according to an embodiment of the present disclosure. The view details sliding punch assembly 170 having a piercing pin 172 including tapered point at the proximate end 174 having slot 173; and threaded male distal end 176 whereas piercing pin 172 is mounted to striking head 178 via threaded receiver 180 as a means for removably connecting piercing pin 172. Referring to FIGS. 2 and 4 driving spring 152 pushes on striking head 178 driving it along the inside of hollow inner tube 112 of guide shaft 116. Striking head 178 also has threaded retainer bolt hole 190 as a means by which punch assembly retainer bolt 148 connects outer sliding sleeve 146 to striking head 178 to a depth that enables clearance for sliding punch assembly 170 to travel without restriction through hollow inner tube 112. Sliding punch assembly 170 motion is limited through a combination of end-member 118 and punch assembly retainer bolt 148 travel along at least one guide slot 114.

Depth of threaded retainer bolt hole 190 is configured such that punch assembly retainer bolt 148 can be tightened against striking head 178 such that striking head 178 is clear of guide shaft 110 as a means for enabling movement and guidance of sliding punch assembly 170 within hollow inner tube 112.

Figure 5:
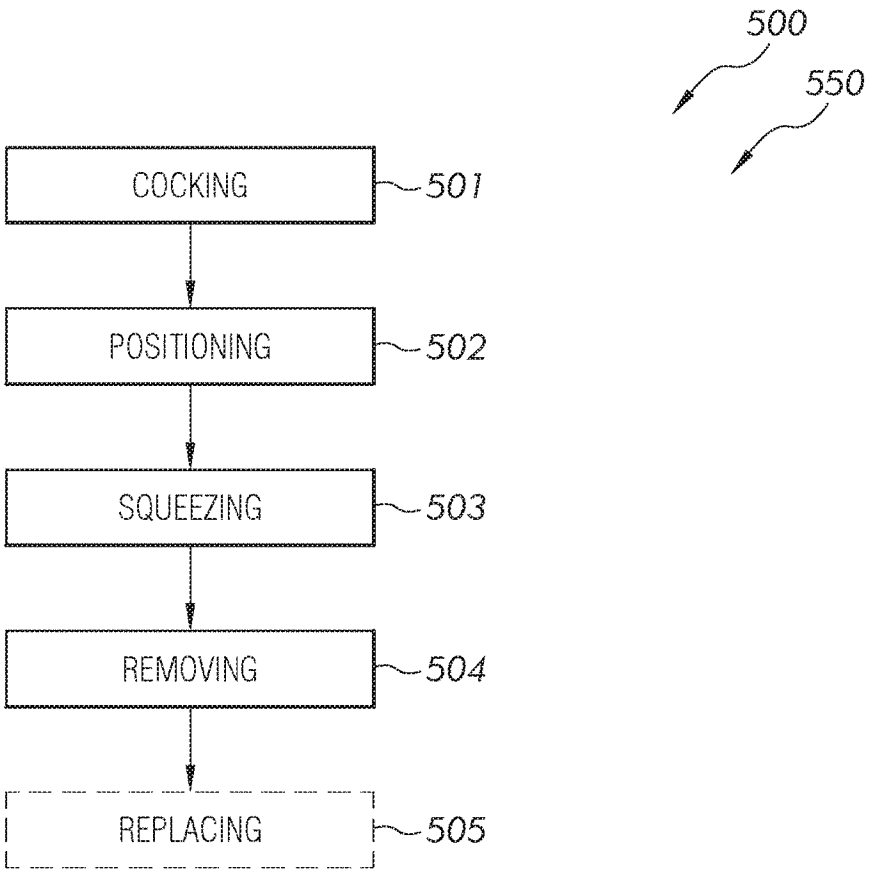
FIG. 5 is a flow diagram illustrating a method of use for a single handed oil filter puncher tool system and method, according to an embodiment of the present disclosure.

FIG. 5 is a flow diagram illustrating a method for a single handed oil filter puncher tool system and method 100, according to an embodiment of the present disclosure. In particular, the method for a single handed oil filter puncher tool system and method 100 method 500 may include one or more components or features of the single handed oil filter puncher tool system and method 100 as described above. As illustrated, the method 500 for a single handed oil filter puncher tool system and method 100 may include the steps of: step one 501, cocking a latching assembly 130 into position by sliding a functional combination of a outer sliding sleeve 146, and a sliding punch assembly 170, in a manner that compresses a driving spring 152 to a point that latching assembly 130 engages a latching notch 162 into a latching cleat 124; step two 502, positioning a puncher tool assembly guide shaft opening against an oil filter mounted to an engine; step three 503, squeezing an activation lever 160; and step four 504, removing a piercing pin 172 of the single handed oil filter puncher tool 102 assembly from oil filter 10 allowing oil filter 10 to drain prior to removal. The method, 500 may further comprise the step of: step five 505, replacing a guide shaft cover for safe storage.

It should be noted that step five is an optional step and may not be implemented in all cases. Optional steps of method of use 500 are illustrated using dotted lines in FIG. 5 so as to distinguish them from the other steps of method of use 500. It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for piercing and removing (e.g., different step orders within above-mentioned list, elimination or addition of certain steps, including or excluding certain maintenance steps, etc.), are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A single handed oil filter puncher tool, the tool comprising:

a puncher tool assembly having;
- a combination handle and guide shaft having;
  - a handle at a proximate end;
  - a guide shaft including;
    - a hollow inner tube;
    - at least one guide slot; and
    - an opening at a distal end;
  - a latch assembly mounting tab having;
    - a latch assembly mounting bolt hole;
  - a latching assembly including;
    - a first pivot nut and bolt assembly;
    - a pivoting latch lever having;
      - latching notch; and
      - a lever tab including;
      - a first lever pivot hole;
    - an activation lever having;
      - a second lever pivot hole;
    - a second pivot nut and bolt assembly; and
    - a latching spring;
- an outer sliding sleeve having;
  - a latching cleat;
- a punch assembly retainer bolt;
- a driving spring;
- a sliding punch assembly including;
  - a piercing pin having;
    - a tapered point at the proximate end; and
    - a threaded male distal end;
  - a striking head having;
    - a threaded receiver and
    - a threaded retainer bolt hole;

wherein said handle and said guide shaft are oriented in a single plane at an angle of ninety degrees with respect to each other;

wherein said handle and said guide shaft work together in functional combination as a structural support and handling means;

wherein said combination handle and guide shaft, said outer sliding sleeve, said sliding punch assembly, and said latching assembly work together in functional combination as a means for single handedly piercing an oil filter when mounted on a vehicle engine;

wherein said sliding punch assembly, said punch assembly retainer bolt, and said outer sliding sleeve work together in functional combination and slide along said guide shaft;

wherein depth of said threaded retainer bolt hole is configured such that said punch assembly retainer bolt can be tightened against said striking head such that said striking head is clear of said guide shaft as a means for enabling movement and guidance of said sliding punch assembly within said hollow inner tube;

wherein said threaded male distal end of said piercing pin is a means for removably connecting said piercing pin from said threaded receiver of said striking head;

wherein said sliding punch assembly is retained within and slides inside said guide shaft by said hollow inner tube;

wherein said outer sliding sleeve is mounted outside and slides along said guide shaft;

wherein said sliding punch assembly is forced along said hollow inner tube by said driving spring;

wherein said sliding punch assembly is cocked into position by sliding said punch assembly retainer bolt and said outer sliding sleeve as a means for compressing said driver spring to a point that said latching assembly engages said latching notch into said latching cleat;

wherein said latching spring automatically engages said latching notch into said latching cleat with and is held into place by force due to said latching spring;

wherein said activation lever is a means for releasing said latching notch from said latching cleat;

wherein said guide slot retains said punch assembly retainer bolt as a means for guiding said sliding punch assembly along said hollow inner tube and said outer sliding sleeve along said guide shaft;

wherein said guide slot limits travel distance of functional combination of said punch assembly retainer bolt along said hollow inner tube and said outer sliding sleeve along said guide shaft; and wherein said latching assembly mounting bolt and said latching assembly mounting self-locking nut are fastened to said latch assembly mounting tab as a means for supporting said latching assembly.

2. The puncher tool assembly of claim 1, wherein said punch assembly retainer bolt is of a wing nut design to provide better leverage for sliding said sliding punch assembly.

3. The puncher tool assembly of claim 1, wherein said tapered point of said piercing pin is slotted for easy removal.

4. The puncher tool assembly of claim 1, wherein said handle contains a gripping surface.

5. The puncher tool assembly of claim 1, wherein said activation lever contains a gripping surface.

6. The puncher tool assembly of claim 1, wherein said guide shaft is approximately one foot in length as a means for reaching into remote oil filter locations.

7. The puncher tool assembly of claim 1, wherein said guide shaft is approximately six inches in length as a means for reaching into oil filter locations in confined spaces.

8. The single handed oil filter puncher tool of claim 1, comprising a guide shaft cover wherein said guide shaft cover is used to protect the user from extended said piercing pin when not in use.

9. The single handed oil filter puncher tool of claim 1, wherein said outer sliding sleeve contains a gripping surface.

10. The single handed oil filter puncher tool of claim 1, wherein said striking head includes an unthreaded, straight-through retainer bolt hole as a means for enabling a punch assembly retainer bolt and nut assembly to fasten said outer sliding sleeve and said sliding punch assembly in functional combination to said guide shaft whereas said punch assembly retainer bolt and nut assembly are tightened together against exterior of said outer sliding sleeve while still enabling sliding movement along said guide shaft.

11. The single handed oil filter puncher tool of claim 1, wherein a distal end of said guide shaft contains an end-member as a means for containing said sliding punch assembly.

12. The single handed oil filter puncher tool of claim 11, wherein end-member is permanently affixed to said guide shaft.

13. The single handed oil filter puncher tool of claim 11, wherein said end-member is removably coupleable from said guide shaft.

14. A single handed oil filter puncher tool, the tool comprising:

a puncher tool assembly having;
- a combination handle and guide shaft having;
  - a handle at a proximate end;
  - a guide shaft including;
    - a hollow inner tube;
    - at least one guide slot; and
    - an opening at a distal end;
  - a latch assembly mounting tab having;
    - a latch assembly mounting bolt hole;
  - a latching assembly including;
    - a first pivot nut and bolt assembly;
    - a pivoting latch lever having;
      - latching notch; and
      - a lever tab including;
      - a first lever pivot hole;
    - an activation lever having;
      - a second lever pivot hole;
    - a second pivot nut and bolt assembly; and
    - a latching spring;
- an outer sliding sleeve having;
  - a latching cleat;
- a punch assembly retainer bolt;
- a driving spring;
- a sliding punch assembly including;
  - a piercing pin having;
    - a tapered point at the proximate end; and
    - a threaded male distal end;
  - a striking head having;
    - a threaded receiver and
    - a threaded retainer bolt hole;

wherein said handle and said guide shaft are oriented in a single plane at an angle of ninety degrees with respect to each other;

wherein said handle and said guide shaft work together in functional combination as a structural support and handling means;

wherein said combination handle and guide shaft, said an outer sliding sleeve, said sliding punch, and said latching assembly work together in functional combination as a means for single handedly piercing an oil filter when mounted on a vehicle engine;

wherein said sliding punch assembly, said punch assembly retainer bolt, and said outer sliding sleeve work together in functional combination to slide along said guide shaft;

wherein depth of said threaded retainer bolt hole is configured such that said punch assembly retainer bolt can be tightened against said striking head such that said striking head is clear of said guide shaft as a means for enabling movement and guidance of said sliding punch assembly within said hollow inner tube;

wherein said threaded male distal end of said piercing pin is a means for removably connecting said piercing pin from said threaded receiver of said striking head;

wherein said sliding punch assembly is retained within and slides inside said guide shaft by said hollow inner tube;

wherein said outer sliding sleeve is mounted outside and slides along said guide shaft;

wherein said sliding punch assembly is forced along said hollow inner tube by said driving spring;

wherein said sliding punch assembly is cocked into position by sliding said punch assembly retainer bolt and said outer sliding sleeve as a means for compressing said driver spring to a point that said latching assembly engages said latching notch into said latching cleat;

wherein said latching spring automatically engages said latching notch into said latching cleat with and is held into place by force due to said latching spring;

wherein said activation lever is a means for releasing said latching notch from said latching cleat;

wherein said guide slot retains said punch assembly retainer bolt as a means for guiding said sliding punch assembly along said hollow inner tube and said outer sliding sleeve along said guide shaft;

wherein said guide slot limits said punch assembly retainer bolt travel distance along said hollow inner tube and said outer sliding sleeve along said guide shaft;

wherein said latching assembly mounting bolt and said latching assembly mounting self-locking nut are fastened to said latch assembly mounting tab as a means for supporting said latching assembly;

wherein said tapered point of said piercing pin is slotted for easy removal;

wherein said handle at the proximate end contains a gripping surface;

wherein said activation lever contains a gripping surface;

wherein said guide shaft is approximately one foot in length as a means for reaching into remote oil filter locations;

a guide shaft cover wherein said guide shaft cover is used to protect the user from extended said piercing pin when not in use;

wherein said outer sliding sleeve contains a gripping surface;

wherein a distal end of said guide shaft contains an end piece as a means for containing said sliding punch assembly; and wherein said end piece is permanently affixed to said guide shaft.

15. The puncher tool assembly of claim 14, further comprising set of instructions and wherein said puncher tool assembly is arranged as a kit including interchangeable said piercing pins, said guide shaft cover.

16. A method of use for the puncher tool assembly of claim 14, the method comprising the steps of:

cocking a latching assembly into position by sliding a functional combination of an outer sliding sleeve and sliding punch assembly in a manner that compresses a driver spring to a point that a latching assembly engages a latching notch into a latching cleat;

positioning a puncher tool assembly guide shaft opening against an oil filter mounted to an engine;

squeezing an activation lever; and removing a piercing pin of the puncher tool assembly from the oil filter.

17. The method, further comprising the step of:

replacing a guide shaft cover for safe storage.

* * * * *